US007549900B2

(12) United States Patent
Kinoshita et al.

(10) Patent No.: US 7,549,900 B2
(45) Date of Patent: Jun. 23, 2009

(54) OPERATION CONTROL APPARATUS FOR PLANING BOAT

(75) Inventors: Yoshimasa Kinoshita, Hamamatsu (JP); Kenichi Fujino, Hamamatsu (JP); Sumihiro Takashima, Hamamatsu (JP); Tatsuya Yoshida, Hamamatsu (JP); Masaru Suzuki, Hamamatsu (JP); Toshiyuki Hattori, Hamamatsu (JP)

(73) Assignee: Yamaha Hatsudoki Kabushiki Kaisha, Shizuoka (JP)

( * ) Notice: Subject to any disclaimer, the term of this patent is extended or adjusted under 35 U.S.C. 154(b) by 0 days.

(21) Appl. No.: 11/754,207

(22) Filed: May 25, 2007

(65) Prior Publication Data

US 2007/0293103 A1 Dec. 20, 2007

(30) Foreign Application Priority Data

May 26, 2006 (JP) ..... 2006-147142

(51) Int. Cl.
*B63H 21/22* (2006.01)

(52) U.S. Cl. ..... 440/1

(58) Field of Classification Search ..... 440/1
See application file for complete search history.

(56) References Cited

U.S. PATENT DOCUMENTS

| | | | | |
|---|---|---|---|---|
| 3,183,879 | A | | 5/1965 | Heidner |
| 3,841,291 | A | | 10/1974 | Ludewig et al. |
| 3,893,108 | A | | 7/1975 | McBride, Jr. et al. |
| 4,019,489 | A | | 4/1977 | Cartmill |
| 4,136,660 | A | | 1/1979 | Palmer et al. |
| 4,423,630 | A | | 1/1984 | Morrison |
| 4,445,473 | A | | 5/1984 | Matsumoto |
| 4,492,195 | A | | 1/1985 | Takahashi et al. |
| 4,556,005 | A | | 12/1985 | Jackson |
| 4,767,363 | A | | 8/1988 | Uchida et al. |
| 4,777,924 | A | | 10/1988 | Fujimura et al. |
| 4,817,466 | A | | 4/1989 | Kawamura et al. |
| 4,888,813 | A | * | 12/1989 | Penn et al. ..... 388/838 |
| 4,895,120 | A | | 1/1990 | Tobinaga et al. |
| 4,913,108 | A | | 4/1990 | Sougawa et al. |
| 4,949,662 | A | | 8/1990 | Kobayashi |
| 4,961,396 | A | | 10/1990 | Sasagawa |
| 4,971,584 | A | | 11/1990 | Inoue et al. |

(Continued)

FOREIGN PATENT DOCUMENTS

| | | |
|---|---|---|
| CA | 2271332 | 2/2000 |

(Continued)

OTHER PUBLICATIONS

Advertisement for trim adjuster for Sea-Doo watercraft—Personal Watercraft Illustrated, Aug. 1998.

(Continued)

*Primary Examiner*—Stephen Avila
(74) *Attorney, Agent, or Firm*—Knobbe, Martens, Olson & Bear, LLP

(57) ABSTRACT

An operating state determining device can determine whether or not an engine is in a certain operating state. A mode setting device can disable mode setting into a speed setting mode if a certain operating state of the engine has been determined, and can enable mode setting into the speed setting mode if the engine is not in the operating state.

11 Claims, 7 Drawing Sheets

U.S. PATENT DOCUMENTS 4,972,792 A 11/1990 Yokoyama et al.
4,972,919 A * 11/1990 Ogawa ..... 180/179
4,989,533 A 2/1991 Horiuchi
5,070,832 A 12/1991 Hapka et al.
5,094,182 A 3/1992 Simner
5,113,777 A 5/1992 Kobayashi
5,118,315 A 6/1992 Funami et al.
5,144,300 A 9/1992 Kanno
5,167,546 A 12/1992 Whipple
5,167,547 A 12/1992 Kobayashi et al.
5,169,348 A 12/1992 Ogiwara et al.
5,184,589 A 2/1993 Nonaka
5,199,261 A 4/1993 Baker
5,203,727 A 4/1993 Fukui
5,244,425 A 9/1993 Tasaki et al.
5,261,844 A 11/1993 Shibata
5,280,772 A 1/1994 Weber et al.
5,314,362 A 5/1994 Nagahora
5,350,325 A 9/1994 Nanami
5,352,138 A 10/1994 Kanno
5,366,394 A 11/1994 Kanno
5,367,970 A 11/1994 Beauchamp et al.
5,408,948 A 4/1995 Arii et al.
5,429,533 A 7/1995 Kobayashi et al.
5,474,007 A 12/1995 Kobayashi
5,494,464 A 2/1996 Kobayashi et al.
5,520,133 A 5/1996 Wiegert
5,538,449 A 7/1996 Richard
5,545,064 A 8/1996 Tsunekawa et al.
5,555,857 A 9/1996 Kanno
5,591,057 A 1/1997 Dai et al.
5,603,644 A 2/1997 Kobayashi et al.
5,665,025 A 9/1997 Katoh
5,669,349 A 9/1997 Iwata et al.
5,687,694 A 11/1997 Kanno
5,697,317 A 12/1997 Pereira
5,701,871 A 12/1997 Munakata et al.
5,707,264 A 1/1998 Kobayashi et al.
5,713,297 A 2/1998 Tani et al.
5,727,522 A 3/1998 Otani et al.
5,805,054 A 9/1998 Baxter
5,826,557 A 10/1998 Motoyama et al.
5,839,700 A 11/1998 Nedderman, Jr.
5,903,215 A 5/1999 Kanno
5,904,604 A 5/1999 Suzuki et al.
5,908,006 A 6/1999 Ibata
5,941,188 A 8/1999 Takashima
5,988,091 A 11/1999 Willis
6,000,371 A 12/1999 Henmi
6,015,319 A 1/2000 Tanaka
6,032,605 A 3/2000 Takashima
6,032,653 A 3/2000 Anamoto
6,038,995 A 3/2000 Karafiath et al.
6,062,154 A 5/2000 Ito
6,086,437 A 7/2000 Murray
6,102,755 A 8/2000 Hoshiba
6,113,442 A 9/2000 Nakamura
6,116,971 A 9/2000 Morikami
6,131,539 A 10/2000 Thomas
6,135,095 A 10/2000 Motose et al.
6,138,601 A 10/2000 Anderson et al.
6,148,777 A 11/2000 Motose et al.
6,159,059 A 12/2000 Bernier et al.
6,168,485 B1 1/2001 Hall et al.
6,171,159 B1 1/2001 Shen et al.
6,174,210 B1 1/2001 Spade et al.
6,174,284 B1 1/2001 Hoshiba et al.
6,178,907 B1 1/2001 Shirah et al.
6,202,584 B1 3/2001 Madachi et al.
6,213,044 B1 4/2001 Rodgers et al.
6,213,820 B1 4/2001 Kanno
6,216,624 B1 4/2001 Page
6,227,919 B1 5/2001 Blanchard
6,244,914 B1 6/2001 Freitag et al.
6,273,771 B1 8/2001 Buckley et al.
6,305,307 B1 10/2001 Yokoya
6,314,900 B1 11/2001 Samuelsen
6,332,816 B1 12/2001 Tsuchiya et al.
6,336,833 B1 1/2002 Rheault et al.
6,336,834 B1 1/2002 Nedderman, Jr. et al.
6,386,930 B2 5/2002 Moffet
6,390,862 B1 5/2002 Eichinger
6,405,669 B2 6/2002 Rheault et al.
6,415,729 B1 7/2002 Nedderman, Jr. et al.
6,428,371 B1 8/2002 Michel et al.
6,428,372 B1 8/2002 Belt
6,443,785 B1 9/2002 Swartz et al.
6,474,307 B1 11/2002 Ohuchi et al.
6,478,638 B2 11/2002 Matsuda et al.
6,484,693 B1 11/2002 Kanno
6,508,680 B2 1/2003 Kanno
6,511,354 B1 1/2003 Gonring et al.
6,520,147 B1 2/2003 Kanno
6,523,489 B2 2/2003 Simzrd et al.
6,530,812 B2 3/2003 Koyano et al.
6,551,152 B2 4/2003 Matsuda et al.
6,565,397 B2 5/2003 Nagafusa
6,568,968 B2 5/2003 Matsuda et al.
6,668,796 B2 12/2003 Umemoto et al.
6,676,462 B2 1/2004 Yanagihara
6,695,657 B2 2/2004 Hattori
6,709,302 B2 3/2004 Yanagihara
6,709,303 B2 3/2004 Umemoto et al.
6,712,651 B2 3/2004 Kanno
6,722,302 B2 4/2004 Matsuda et al.
6,722,932 B2 4/2004 Yanagihara
6,732,707 B2 5/2004 Kidokoro et al.
6,733,350 B2 5/2004 Iida et al.
6,776,676 B2 8/2004 Tanaka et al.
6,783,408 B2 8/2004 Uraki et al.
6,805,094 B2 10/2004 Hashimoto et al.
6,827,031 B2 12/2004 Aoyama
6,848,956 B2 * 2/2005 Ozawa ..... 440/1
6,855,014 B2 2/2005 Kinoshita et al.
6,863,580 B2 3/2005 Okuyama
6,884,128 B2 4/2005 Okuyama et al.
6,886,529 B2 5/2005 Suzuki et al.
6,990,953 B2 1/2006 Nakahara et al.
6,997,763 B2 2/2006 Kaji
7,077,713 B2 7/2006 Watabe et al.
7,168,995 B2 1/2007 Masui et al.
7,175,490 B2 2/2007 Kanno et al.
7,207,856 B2 4/2007 Ishida et al.
2001/0051474 A1 12/2001 Matsuda et al.
2002/0049013 A1 4/2002 Kanno
2003/0000500 A1 1/2003 Chatfield
2003/0013354 A1 * 1/2003 Yanagihara ..... 440/1
2003/0089166 A1 5/2003 Mizuno et al.
2004/0067700 A1 4/2004 Kinoshita et al.
2004/0069271 A1 4/2004 Kanno et al.
2004/0087222 A1 * 5/2004 Kinoshita et al. ..... 440/1
2004/0147179 A1 7/2004 Mizuno et al.
2005/0263132 A1 12/2005 Yanagihara
2005/0273224 A1 12/2005 Ito et al.
2005/0287886 A1 12/2005 Ito et al.
2006/0004502 A1 1/2006 Kaneko et al.
2006/0037522 A1 2/2006 Kaneko et al.

FOREIGN PATENT DOCUMENTS

JP 55-117045 9/1980
JP 56-106044 8/1981
JP 57-129241 8/1982
JP 62-126222 6/1987

| | | | |
|---|---|---|---|
| JP | 04-133894 | | 5/1992 |
| JP | 06-137248 | | 5/1994 |
| JP | 7-40476 | | 9/1995 |
| JP | 09-079125 | | 3/1997 |
| JP | 10-274082 | | 10/1998 |
| JP | 2001-152895 | | 6/2001 |
| JP | 2001-329881 | | 11/2001 |
| JP | 2002-180861 | | 6/2002 |
| JP | 2002-180861 | A | 6/2002 |
| JP | 2002-371875 | | 12/2002 |
| JP | 2004-092640 | | 3/2004 |
| JP | 2004-137920 | | 5/2004 |
| WO | WO 00-40462 | | 7/2000 |

OTHER PUBLICATIONS

Advertisement for trim adjuster—Jet Sports, Aug. 1997.
Advertisement for Fit and Trim and Fit and Trim II—Jet Sports, Aug. 1996.

* cited by examiner

[FIG. 1]
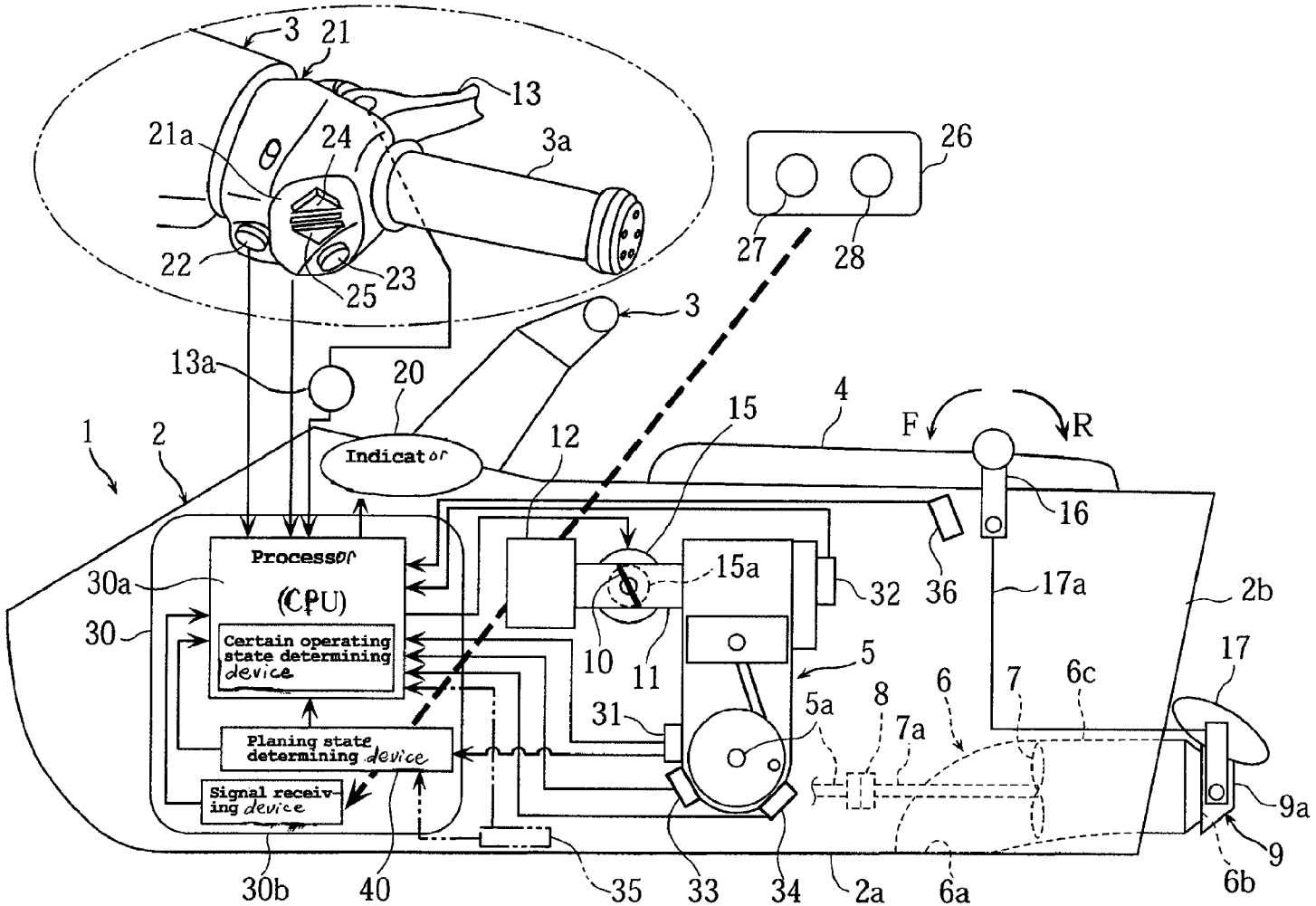

[FIG. 2]
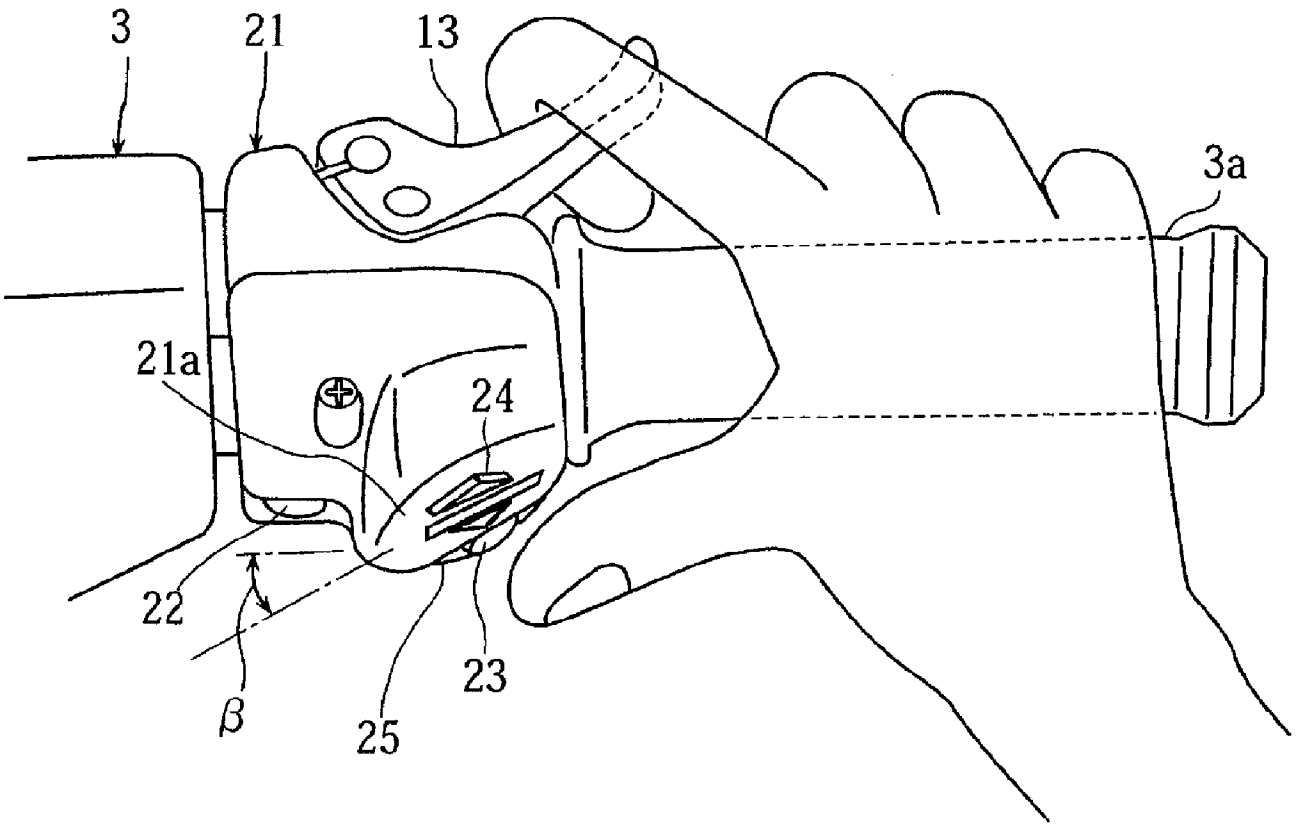

[FIG. 3]
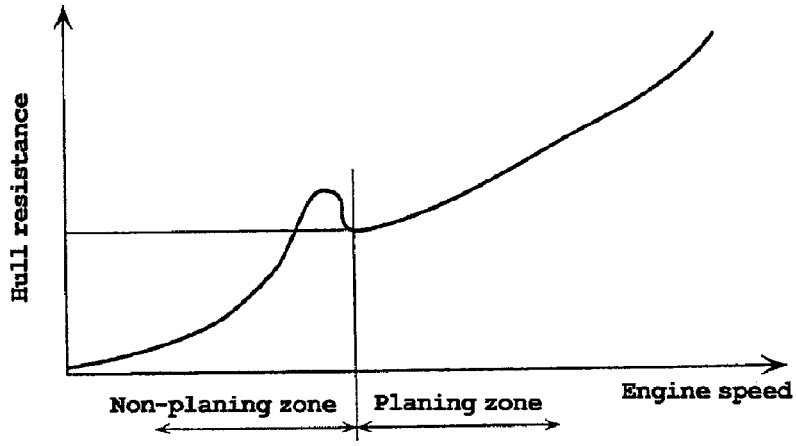
[FIG. 4]
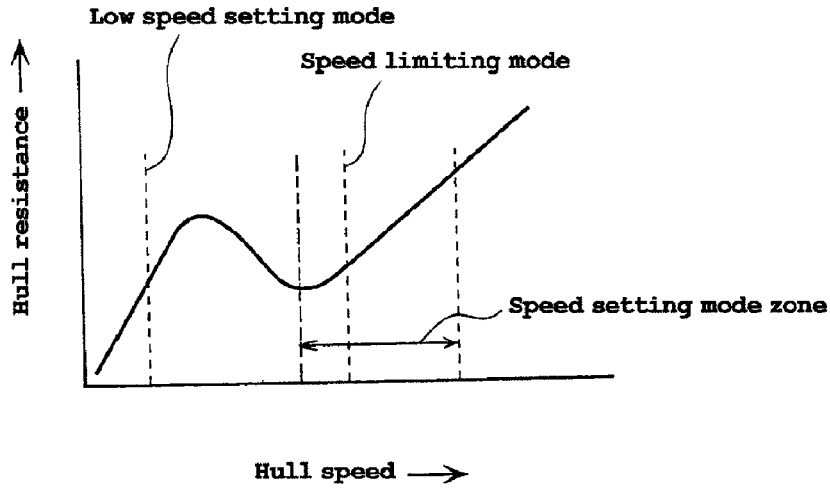

[FIG. 5]
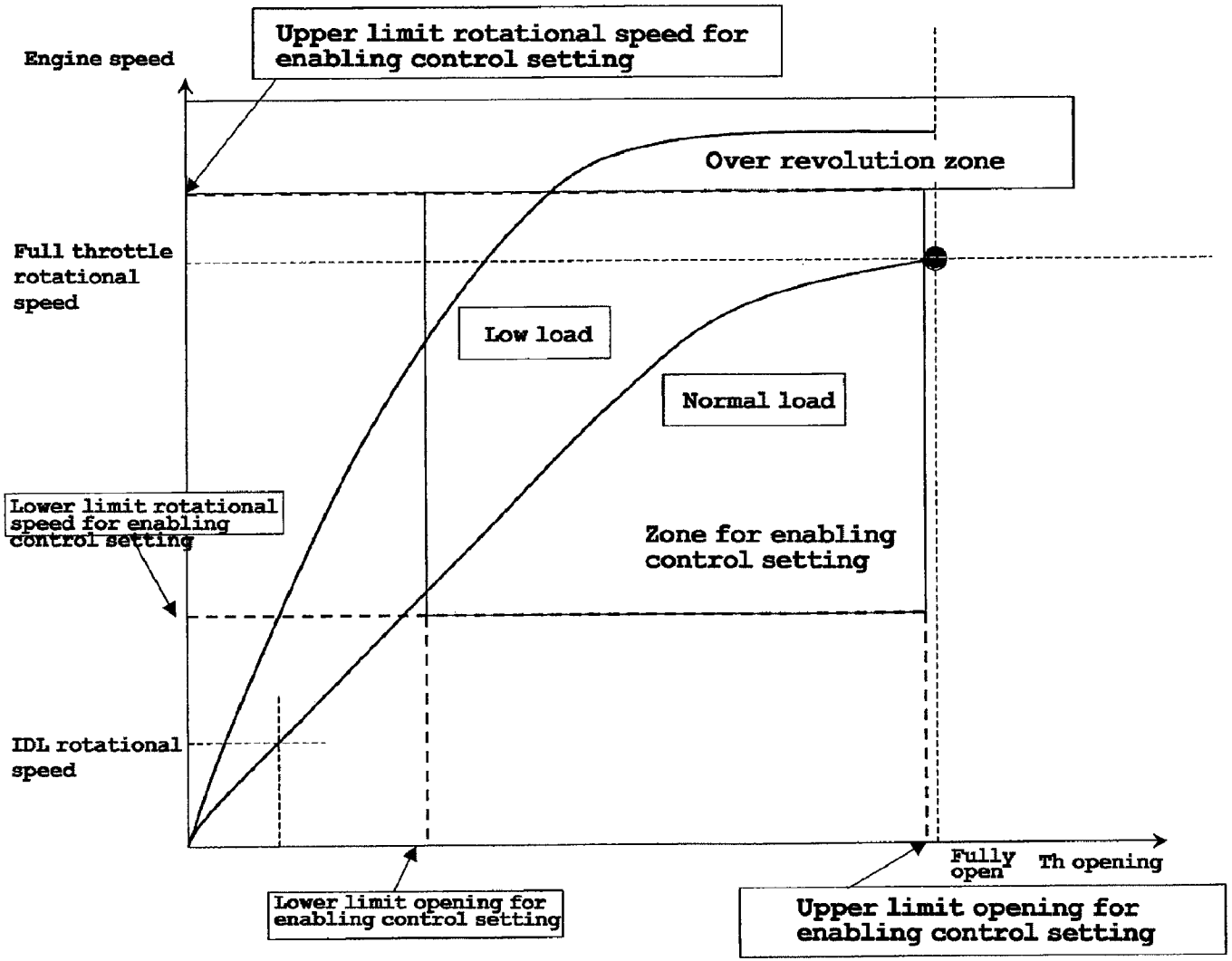

[FIG. 6]
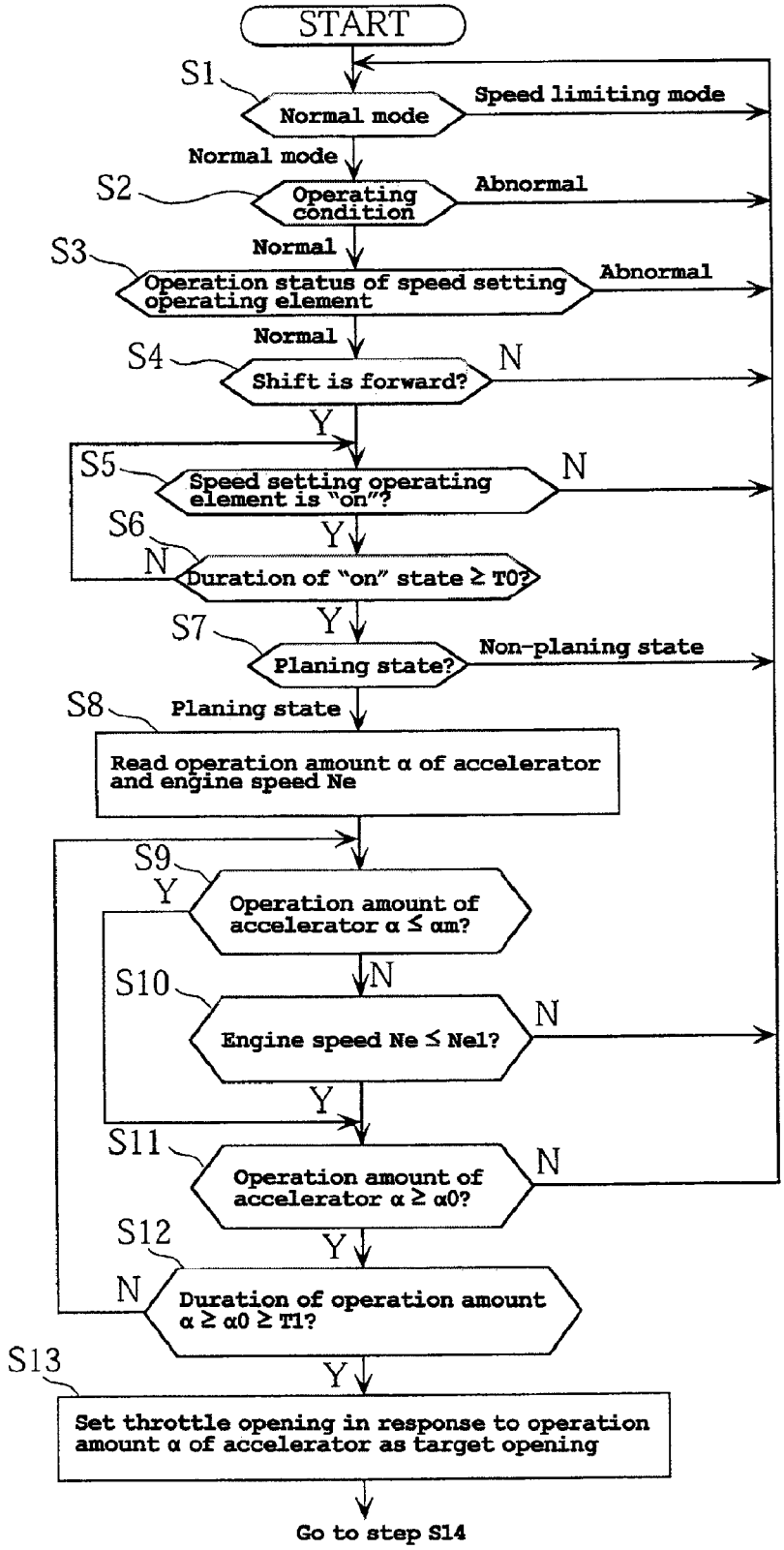

[FIG. 7]
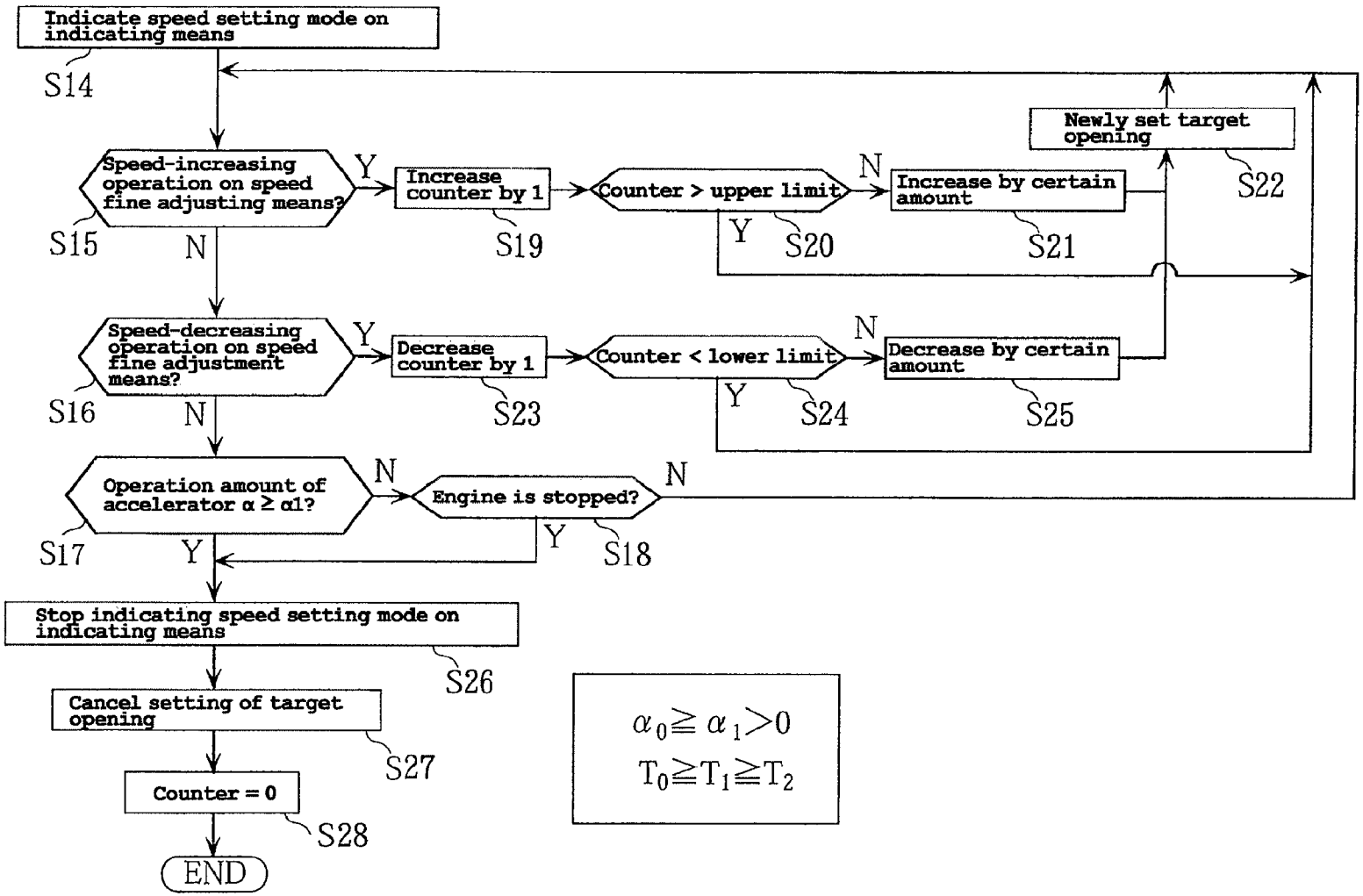

[FIG. 8]
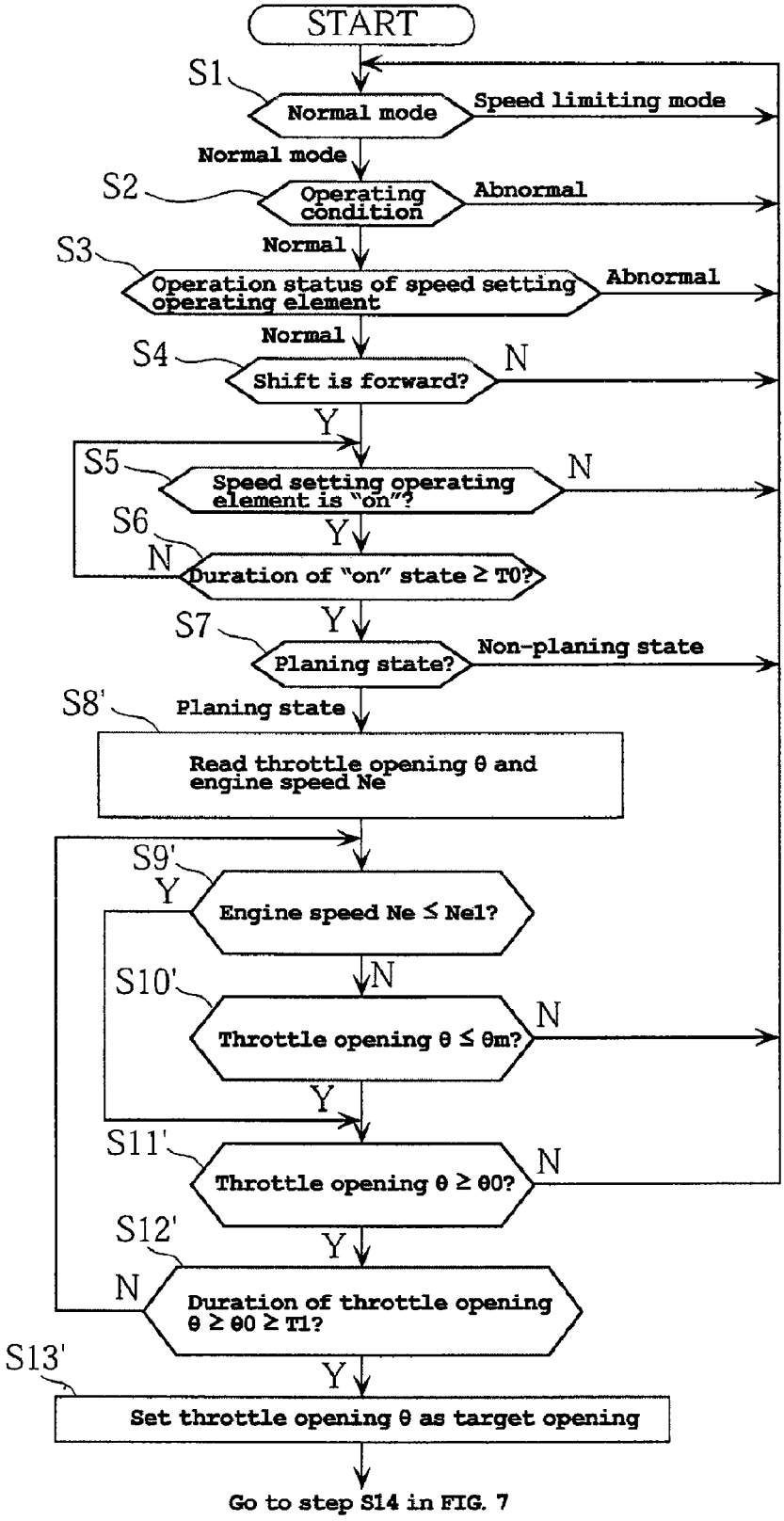

OPERATION CONTROL APPARATUS FOR PLANING BOAT

PRIORITY INFORMATION

This application claims priority to Japanese patent application Serial No. 2006-147142, filed on May 26, 2006, the entire contents of each of these priority applications are hereby expressly incorporated by reference.

BACKGROUND OF THE INVENTIONS

1. Field of the Inventions

The present inventions relate to planing boats having propulsion devices through which water is sucked in through a suction opening at a bottom of its hull and is pressurized and jetted rearward of the stern to make the boat plane on water, and more particularly to an improved operation control apparatus.

2. Description of the Related Art

Generally, small planing boats, such as personal watercraft, are configured such that engine output is adjusted by the operator using an accelerator (acceleration or throttle lever) provided in the vicinity of a grip of steering handlebars. During longer distance cruising at a constant speed, the operator has to continue to grip the acceleration lever and maintain the position of the lever at a particular position, resulting in tiredness of the arm and fingers. To solve this problem, a cruise control device has been suggested such that longer distance driving at a constant speed is possible without causing tiredness of the arm and so forth.

One such cruise control device is disclosed in Japanese Patent Document JP-A-2002-180861. This device can maintain a boat speed or engine speed when the operator operates cruise control device.

SUMMARY OF THE INVENTIONS

The water vehicles are driven mainly on the water such as the sea. The water surface (especially the sea surface) is different from roads on land, and its condition easily changes. Also, the water vehicles are often driven with the throttle valve fully opened, unlike automobiles and so forth. Therefore, when the boat overcomes a wave for example, a suction opening of the propulsion device will be momentarily exposed to the air, so that the engine may go into an over revolution state due to a decrease in load on the engine. In normal driving, the over revolution state occurs in a very short period, and causes almost no influence on the engine. However, if the cruise controlling means is operated when the engine is in the over revolution state, such state will be maintained and may cause engine trouble.

Thus, in accordance with an embodiment, an operation control apparatus for a planing boat can comprise an engine, a throttle valve configured to adjust an amount of airflow to the engine, and an accelerator configured to allow an operator to control an opening of the throttle valve. A mode setting device can be configured to selectively set one of a normal driving mode and a speed setting mode, wherein the normal driving mode enables the boat to run at a speed in response to an operation amount of the accelerator and the speed setting mode enables the boat to run at a certain speed when a speed setting operating element has been operated. An operating state determining device can be configured to determine whether or not the engine is in a certain operating state. The mode setting device can be configured to disable mode setting into the speed setting mode if the certain operating state of the engine has been determined, and to enable mode setting into the speed setting mode if the engine is not in the certain operating state.

In accordance with another embodiment, an operation control apparatus for a planing boat can comprise an engine, a power output request device configured to allow an operator of the planing boat to issue a request for power from the engine, and a speed control mode input device configured to allow an operator of the boat to issue a speed control mode switching command for switching between a normal mode and a speed control mode. A controller can be configured to control a power output of the engine based on the request from the power output request device, the controller operating the engine at a speed in response to the request from the power output request device in the normal mode and operating the engine at a speed chosen by the operator with the speed control mode input device. A mode setting device can be configured to selectively set one of the normal mode and the speed setting mode based in part on the switching command, wherein the normal driving mode enables the boat to run at a speed in response to an operation amount of the accelerator and the speed setting mode enables the boat to run at a certain speed when a speed setting operating element has been operated. Additionally, an operating state determining device can be configured to determine whether or not the engine is in a certain operating state. The mode setting device can also be configured to disable mode setting into the speed setting mode if the certain operating state of the engine has been determined, and to enable mode setting into the speed setting mode if the engine is not in the certain operating state.

In accordance with yet another an operation control apparatus for a planing boat can comprise an engine, a power output request device configured to allow an operator of the planing boat to issue a request for power from the engine, and a speed control mode input device configured to allow an operator of the boat to issue a speed control mode switching command for switching between a normal mode and a speed control mode. A controller can be configured to control a power output of the engine based on the request from the power output request device, the controller operating the engine at a speed in response to the request from the power output request device in the normal mode and operating the engine at a speed chosen by the operator with the speed control mode input device. A mode setting device can be configured to selectively set one of the normal mode and the speed setting mode based in part on the switching command, wherein the normal driving mode enables the boat to run at a speed in response to an operation amount of the accelerator and the speed setting mode enables the boat to run at a certain speed when a speed setting operating element has been operated. The mode setting device can be configured to maintain the speed setting mode when the power output request device is adjusted within a range between a minimum power output request value and a maximum power output request value.

BRIEF DESCRIPTION OF THE DRAWINGS

The above-mentioned and other features of the inventions disclosed herein are described below with reference to the drawings of the preferred embodiments. The illustrated embodiments are intended to illustrate, but not to limit the inventions. The drawings contain the following Figures:

FIG. 1 is a schematic diagram of a planing boat with an operation control apparatus according to an embodiment.

FIG. 2 is an enlarged perspective view of a steering handlebar of the planing boat shown in FIG. 1, showing an operator holding a grip of the handle bar and operating a throttle lever.

FIG. 3 is a diagram illustrating an exemplary relationship between hull resistance and the engine speed of the planing boat shown in FIG. 1.

FIG. 4 is a diagram illustrating exemplary operation mode zones of the planing boat shown in FIG. 1.

FIG. 5 is a diagram illustrating an exemplary relationship between engine speed and throttle opening, and illustrating an exemplary zone for enabling a mode setting into a speed setting mode of the planing boat shown in FIG. 1.

FIG. 6 is a flowchart illustrating an embodiment of a first part of a control operation of the operation control apparatus shown in FIG. 1.

FIG. 7 is a flowchart illustrating an embodiment of a second part of the control operation of FIG. 6.

FIG. 8 is a flowchart illustrating a modification of the first part of the control operation of FIG. 6.

DETAILED DESCRIPTION OF THE PREFERRED EMBODIMENTS

FIGS. 1 through 7 are drawings for describing an operation control apparatus for a planing boat 1 according to an embodiment, which can be a small watercraft, such as a personal watercraft. The embodiments disclosed herein are described in the context of a personal watercraft because the embodiments disclosed herein have particular utility in this context. However, the embodiments and inventions herein can also be applied to other boats having other types of propulsion units as well as other types of vehicles.

In some embodiments, the planing boat 1 can include steering handlebars 3 disposed on the front part of the upper surface of a box-shaped hull 2. The hull 2 can be generally watertight, except, in some embodiments, the boat 1 can include ventilation device configured to allow atmospheric air to flow into and out of the interior of the hull 2. A straddle type seat 4 can be disposed at the rear part of the upper surface, and an engine 5 and a propulsion device 6 can be disposed in the hull 2.

The propulsion device 6 can include a suction opening 6*a* at a bottom 2*a* of the hull 2 and a discharge opening 6*b* at a stern 2*b*. The openings 6*a*, 6*b*, can be connected by a propulsion path 6*c*.

An impeller 7 can be disposed in the propulsion path 6*c*. An impeller shaft 7*a* of the impeller 7 can be coupled to a crankshaft 5*a* of the engine 5 via a coupling 8. The impeller shaft 7*a* can be formed of a single shaft, or a plurality of shafts connected together with, for example, splined shaft connections. The impeller 7 can thus be driven by the engine 5, thereby sucking water in from the suction opening 6*a*, pressurizing the water, and jetting the water out rearwardly from the discharge opening 6*b*, and thus providing thrust for propulsion.

A jet nozzle 9 can be connected to the discharge opening 6*b* in a manner such that it can be swung toward the left and right sides. This jet nozzle 9 swings left and right by steering the steering handlebars 3 left and right, and thereby the hull 2 can be turned left and right.

The engine 5 can be mounted with the crankshaft 5*a* extending in the fore to aft direction of the hull. A throttle body 11 housing a throttle valve 10 therein can be connected to this engine 5. An intake air silencer 12 can be connected to the upstream end of the throttle body 11.

The throttle valve 10 can be opened and closed by operating an accelerator (acceleration lever) 13 disposed on a grip 3*a* of the steering handlebars 3. An actuator 15 for driving for opening and closing the throttle valve 10 can be connected to this throttle valve 10, and the actuator 15 can be controlled by a control unit 30 described below. In such embodiments, the accelerator 13 can be considered a "power output request device" or a "torque request device." In other words, the operator of the boat 1 can request power output or torque output from the engine 1 by moving the accelerator 13. The control until 30 can control the throttle valve 10, and or other devices described below, to provide the power or torque output corresponding to the position to which the operator has moved the accelerator 13.

A forward-reverse switching lever (forward-reverse switching means) 16 can be disposed in the vicinity of the seat of the hull 2. This forward-reverse switching lever 16 can be coupled with a reverse bucket 17 disposed on the jet nozzle 9 by an operating cable 17*a*.

When the forward-reverse lever 16 is rotated to a forward position F, the reverse bucket 17 can open a jet opening 9*a* of the jet nozzle 9 and water flow can be jetted rearwardly thereby providing a net forward thrust and thus moving the hull 2 forwardly. If the forward-reverse switching lever 16 is rotated to a reverse position R, the reverse bucket 17 can be positioned rearward of the jet opening 9*a*, thereby diverting the water flow forwardly, which creates a net rearward thrust, and moves the hull 2 rearwardly.

An operating box 21 can be disposed on the steering handlebars 3 of the hull 2, and an indicator 20 can be disposed at the front part of the steering wheel 3. Reference numeral 26 denotes a remote control switch. This remote control switch 26 can be disposed on the hull. However, other configurations can also be used.

The indicator 20 can include a speed meter, a fuel meter, various indication lamps (not shown) as well as other indicators, and lights a corresponding indication lamp when any of low speed setting mode, speed limiting mode, and speed setting mode mentioned below are selected.

The operating box 21 can be disposed in the proximity to the grip 3*a* of the steering handlebars 3 inside in the transverse direction. The operating box 21 can have a switch mounting surface 21*a* that can be positioned toward the grip 3*a* to have a tilt angle of β to the axis of the grip 3*a*.

A speed setting switch 23 and speed-increasing and speed-decreasing fine adjustment switches 24 and 25 can also be disposed on this switch mounting surface 21*a*. These switches 23 through 25 can be disposed in the area such that the operator can operate them by the thumb with gripping the grip 3*a*, and the operability of these switches can be improved because of the tilt angle β. A speed limiting switch 27 and speed limit cancellation switch 28 can be disposed on a remote control switch 26.

Further, a low speed setting switch 22 can be disposed apart from the grip 3*a* of the switch disposing surface 21*a* and recessed slightly forwardly. This low speed setting switch 22 can be operated by releasing the finger from the acceleration lever 13. Therefore, in some embodiments, the low speed setting switch 22 can be disposed in a position apart from the grip 3*a*, with the switch mounting surface 21*a* therebetween, and in a position recessed slightly forwardly. Thereby, the operator can operate the low speed setting switch 22 with unconsciously releasing the finger from the acceleration lever 13.

The planing boat 1, as noted above, can include the control unit 30 for controlling the operation of the whole boat including the engine 5. The control unit 30 can be configured to receive input of detection values from various sensors such as an engine speed sensor 31, a throttle opening sensor 15*a*, an accelerator operation amount sensor 13*a*, an engine coolant temperature sensor 32, a lubricant temperature sensor 33, a lubricant pressure sensor 34, a running speed sensor 35, a forward-reverse position sensor 36, and/or other sensors.

The control unit 30 can include an electronic control unit, which in some embodiments can include a processor, or a "Central Processing Unit" (CPU) 30*a* for controlling the actuator 15 and/or other devices. Operating signals can be input into the control unit 30 from the low speed setting switch 22, the speed setting switch 23, the speed-increasing and speed-decreasing fine adjustment switches 24 and 25 and also operating signals are input from the speed limiting switch 27 and the speed limit cancellation switch 28 via receiving means 30*b*. The control unit 30 sets various running modes based on these operating signals of the switches (see FIG. 4).

For example, a normal driving mode can be set during engine start if the operator performs no particular switch operation. In this normal driving mode, the boat will run at a speed in response to the amount of operation of the acceleration lever 13 by the operator. When this normal driving mode is set, if the low speed setting switch 22 is pressed and held for a prescribed period of time with the acceleration lever 13 released, the control unit 30 sets the mode into the low speed setting mode, and controls the throttle opening so that a preset speed (e.g. 8 km/h) can be obtained. This low speed setting mode can be selected, for example, when the boat runs in no wake zones such as shallow waters and moorings where running speed can be restricted.

When the normal driving mode is set, if the speed limiting switch 27 is pressed, and in some embodiments, held for a predetermined period of time, the control unit 30 changes modes into the speed limiting mode, and controls the throttle opening so that a preset engine speed is maintained and/or not exceeded. This speed limiting mode is selected when the boat runs in zones where the running speed is restricted or when the boat 1 is driven for an extended cruise.

When the normal driving mode is set, if the speed setting switch 23 is pressed and held for a predetermined period of time, the control unit 30 sets the running mode into the speed setting mode, that is an auto cruising mode, based on the conditions below, and controls the throttle opening so that the running speed when the speed setting switch 23 has been pressed is maintained. This speed setting mode can be selected when the operator operates the boat at a desired speed in a low-to-high speed range or at a fuel efficient cruising speed.

In some embodiments, the control unit 30 can be configured to enable or disable a mode setting into the speed setting mode as follows:

(1) When the speed limiting mode described above is selected, a mode setting into the speed setting mode can be disabled.

(2) The control unit 30 can be configured to determine whether or not the engine 5 is in a certain operating state and the hull is in the planing state. If the planing state of the hull 2 and no certain operating state of the engine 5 has been determined, the control unit 30 enables a mode setting into the speed setting mode. If no planing state or a certain operating state has been determined, the control unit 30 disables a mode setting into the speed setting mode. For example, (i) if an engine speed of the engine 5 is greater than a preset upper limit (upper limit rotational speed for enabling control setting shown in FIG. 5), it can be determined that the engine is in a certain operating state, and thus a mode setting into the speed setting mode can be disabled. Also, if engine speed is smaller than a lower limit rotational speed for enabling control setting shown in FIG. 5, a mode setting into the speed setting mode can be disabled.

(ii) If the operation amount of the accelerator is greater than a preset upper limit, it can be determined that the engine 5 is in a certain operating state, and thus a mode setting into the speed setting mode can be disabled.

(iii) If the opening of the throttle valve is greater than a preset upper limit (upper limit opening for enabling control setting shown in FIG. 5), it can be determined that the engine 5 is in a certain operating state, and thus a mode setting into the speed setting mode can be disabled. Also, if the throttle opening is smaller than a lower limit opening for enabling control setting shown in FIG. 5, a mode setting into the speed setting mode can be disabled.

However, these are merely some examples of the operating states that can be sued for enabling or disabling speed setting modes. Other operating states can also be sued.

The control unit 30 can include a planing state determining device 40 configured to determine whether or not the hull 2 is in the planing state as described above. If the planing state determining device 40 has determined that the hull is in the planing state and if no certain operating state of the engine has been determined as described above, switching into the speed setting mode can be enabled. If no planing state of the hull has been determined, switching into the speed setting mode can be disabled.

For example, if a moving average computed using the engine speed detection values continues to be smaller than a preset value for a prescribed period of time, the hull 2 can be determined to be in a non-planing state. If a moving average continues to be larger than the preset value for a prescribed period of time, the hull 2 can be determined to be in a planing state.

Here, the moving average described above refers to an engine speed obtained by simple moving averaging, weighted moving averaging, and exponential smoothing moving averaging. For example, assuming that engine speeds sampled by the engine speed sensor 31 at certain time intervals are N1, N2, N3, and N4, when moving average Ne is obtained by the simple moving averaging function, $Ne=(N1+N2+N3+N4)/4$. A weighted moving average Ne can be obtained by the weighted moving averaging function, $Ne=(N1\times K1+N2\times K2+N3\times K3+N4\times K4)/(K1+K2+K3+K4)$, wherein Kn is a sampling weight coefficient, and $Kn>Kn-1>1$. A moving average Net at time "t" can be obtained by the exponential smoothing moving averaging function, $Net=Net-1+(Nt-Net-1)\times K$, wherein K is a resistance coefficient of the boat. However, other functions can also be used to estimate watercraft speed or planing state from detected engine speed values.

FIG. 3 illustrates an exemplary relationship between engine speed and hull resistance. As shown in FIG. 3, there can be a significant increase in hull resistance on the border between the non-planing zone and the planing zone.

As the engine speed, and thus, running speed increases from an idle state toward the border between the planing and non-planing zones, the center of gravity of the hull will shift toward the rear part of the hull, so that the hull resistance will sharply increase. As the engine speed (running speed) further increases and reaches a so-called hump speed, the center of gravity of the hull will shift toward the front part of the hull 2 and the hull 2 will rise out of the water, thereby reducing the wetted area of the hull surface, and thus the hull resistance will decrease. The zone from this point onward can be called a planing zone.

An embodiment of a control operation that can be performed by the control unit 30 is described with reference to the flowcharts of FIGS. 6 and 7. When a main switch is turned on and the engine is started, it can be determined whether or not a mode setting is the normal driving mode. If it is the normal driving mode, it can be determined whether or not operating conditions of the engine and the sensors are normal.

It can also be determined whether or not the operation status of the speed setting switch 23 is normal (steps S1 through S3).

If everything is normal in these steps S2 and S3, it can be determined whether or not a shift position of the forward-reverse switching lever 16 is in the forward side (step S4). If it is in the forward position F, it can be determined whether or not the speed setting switch 23 has been turned on (step S5).

If a mode setting is the speed limiting mode in step 1, if there is a failure in the engine operating conditions and switch operation status in steps S2 and S3, and if a shift position is in the reverse position in step S4, the process returns to step S1 and the processing can be repeated.

In the determination on the engine operating conditions (Step S2), a failure can be determined if at least one of a lubricant temperature, a coolant temperature, and a lubricant pressure is larger than a preset value.

In the determination on the operation status of the speed setting switch 23 (Step S3), a failure can be determined if a voltage of a lead wire connecting the switch to the control unit 30 falls outside the range of normal values. Also, if a normal voltage during operator's operation of the speed setting switch 23 continues for a prescribed period of time or longer, a failure can be determined assuming that the speed setting switch 23 might have seized up in the "on" state due to dust or the like.

In step S5, when the speed setting switch 23 is turned on, duration of the "on" state can be monitored. If the duration reaches a preset period T0 or larger, it can be determined whether or not the hull is in the planing state (steps S6 and S7). In step S6, if duration of the "on" state is smaller than T0, the process returns to step 5.

If the planing state of the hull has been determined in step S7, an operation amount $\alpha$ of the acceleration lever 13 and an engine speed Ne are read (step S8). If this operation amount $\alpha$ is equal to or smaller than an upper limit operation amount $\alpha$m preset as a reference value for determining a certain operating state of the engine (step S9), or an operation amount $\alpha$ is larger than $\alpha$m and an engine speed Ne is equal to or smaller than an upper limit rotational speed Ne1 preset as a reference value for determining a certain operating state of the engine (step S10), and if the accelerator operation amount $\alpha$ is equal to or larger than a preset lower limit $\alpha$0 (step S11), duration of the operation amount $\alpha$ is monitored. If the duration becomes equal to or larger than T1 (step S12), a throttle opening in response to the operation amount $\alpha$ is set as a target throttle opening and it can be indicated by lighting the indication lamp that the speed setting mode is selected (steps S13 and S14). The throttle valve 10 can be selectively opened and closed through the actuator 15 so that the target throttle opening is achieved.

When the boat is running in the speed setting mode, if a speed-increasing and speed-decreasing fine adjustment is not made, an operation amount $\alpha$ of the acceleration lever 13 is equal to or smaller than a preset operation amount $\alpha$1, and the engine 5 is not stopped, the speed setting mode is held (steps S15 through S18).

If the speed-increasing fine adjustment switch 24 is pressed in step S15, a counter value can be increased by one. If the counter value has not reached an upper limit, the throttle opening is increased by a certain amount and the increased throttle opening is newly set as a target throttle opening (steps S19 through S22). If the speed-decreasing fine adjustment switch 25 is pressed in step S16, a counter value can be decreased by one. If the counter value has not reached a lower limit, the throttle opening can be decreased by a certain amount and the decreased throttle opening can be newly set as a target throttle opening (steps S23 through S25).

If an operation amount $\alpha$ of the acceleration lever 13 becomes smaller than the preset value $\alpha$1, it can be determined that the operator wants to cancel the speed setting mode, so that the lamp indicating the speed setting mode can be turned off. For example, this can occur of the operator releases the accelerator 13. A setting of a target throttle opening is then cancelled and the increase or decrease counter can be reset to zero (steps S26 through S28). Thereby, the driving mode can be automatically switched to the normal driving mode. If the engine is stopped in step S18, the speed setting mode can be cancelled and the running mode can be automatically switched to the normal driving mode.

As described above, according to this embodiment, when the speed setting switch 23 is pressed and held for a prescribed period of time, it can be determined whether or not the hull 2 is in the planing state and whether or not the engine 5 is in a certain operating state, for example, an over revolution state (engine speed is too high). Thus, switching into the speed setting mode can be allowed only if the hull 2 is in the planing state and the engine 5 is not in a certain operating state, such as over revolution. Thus, the engine 5 will not be held in an over revolution state, and therefore, significant damage to the engine 5 can be avoided.

On the other hand, since switching into the speed setting mode can be enabled only when the hull 2 is in the planing state, the speed of the watercraft when the operator sets the speed setting mode should not change, so that a natural running feeling can be provided without any discomfort. For example, if an operator suddenly pulls the accelerator 13 when the engine 5 is idling, raising the engine speed to a planing mode speed, and sets the speed setting mode, the watercraft will initially move forward in a displacement mode (a non-planing state) and thereafter continue to accelerate, even though the engine speed is not changed. This is because, when the accelerator 13 is first pulled, the hull 2 is fully wetted and thus, the hull resistance is at its maximum. Then as the boat 1 accelerates, the hull 2 will transition into the planing mode in which the hull resistance is much lower, thereby allowing the hull 2 to travel at a higher speed.

In this embodiment, it can be determined that the hull is not in the planing state when a moving average obtained using engine speeds continues to be smaller than a preset value for a prescribed period of time. Thus, the planing state determination can be made based on an estimated boat speed with the inexpensive and simple configuration. Therefore, the accuracy of determination can be improved compared to when raw engine speed alone is used for this determination.

In some embodiments, where a mode setting into the speed setting mode can be disabled when the forward-reverse switching lever 16 is in the reverse position R, the operator does not have to make unnecessary operation. That is, switching into the speed setting mode during reverse driving is unnecessary.

In some embodiments, when the boat is running in the speed setting mode, if an accelerator operation amount $\alpha$ is a prescribed operation amount $\alpha$1 or larger, the speed setting mode can be held. Therefore, the operation for retaining the speed setting mode is facilitated, and the operator can easily be aware that the boat is running in the speed setting mode.

In some embodiments, when an accelerator operation amount $\alpha$ becomes smaller than the prescribed operation amount $\alpha$1, the speed setting mode can be cancelled and the running mode can be automatically switched to the normal driving mode. Therefore, switching into the normal driving mode can be made quickly with a simple operation. In these embodiments, the operator can move the accelerator 13 over a range of movement, which corresponds to a range of output values of the sensor 13*a*, without causing the speed setting mode to be cancelled. Thus, the engine 5 can continue to remain operating at the speed chosen by the operator, even though the accelerator 13 is moved over this range, for example, between α1 and the value output from the sensor 13*a* when the accelerator 13 is fully depressed, or another lower value.

As such, the operator can continue to cruise at a chosen speed without having to keep the accelerator 13 at a precise location. Rather, the operator can move the accelerator 13 so that the operator's finger does not become uncomfortable, while the speed of the engine 5 is maintained at the chosen speed.

In some embodiments, a mode setting into the speed setting mode can be disabled when a failure occurs in the engine operating conditions or the various sensors. Thus, the operator can be easily aware of any failure, and trouble due to continued engine failure can be prevented.

A mode setting into the speed setting mode can also be disabled when a failure occurs in the operation status of the speed setting switch 23. Thus, the operator can be easily aware of any failure, and trouble due to continued failure of the speed setting switch 23 can be prevented.

In some embodiments, the speed-increasing and speed-decreasing fine adjustment switches 24 and 25 can be provided to allow the operator to finely adjust the running speed when the boat is running in the speed setting mode. Therefore, the running speed can be finely adjusted according to the preference of the operator.

FIG. 8 is a flowchart of a modification of the control operation of FIGS. 6 and 7. In this modification, enabling and disabling of the speed setting mode can be implemented based on the planing state of the hull, and engine speed or a throttle opening. In FIG. 8, the same reference numerals as those in FIG. 6 denote the same or equivalent steps.

In the normal driving mode, if the engine operation conditions and the operation status of the speed setting switch are normal, a shift position is in the forward position, and the speed setting switch is turned on, the control operation can proceed to Step S6. When the duration of the "on" state of the speed setting switch becomes T0 or larger (Step S6), it can be determined that the operator has selected the auto cruise driving, and then it can be determined whether or not the hull is in the planing state (Step S7).

If the planing state of the hull has been determined, a throttle opening θ and an engine speed Ne are read (step S8'). If this engine speed Ne is an upper limit rotational speed Ne1 or smaller (step S9'), or if the engine speed Ne is larger than Ne1 and the throttle opening θ is equal to or smaller than an upper limit opening θm preset as a reference value for determining a certain operating state of the engine (step S10'), and the throttle opening θ is a prescribed lower limit θ0 or larger (step S11'), duration of the throttle opening θ is monitored. If the duration becomes T1 or larger (step S12'), the throttle opening θ is set as a target throttle opening, and then the process proceeds to step S14 in FIG. 7.

A mode switching to the speed setting mode is enabled only when the hull is in the planing state, and non-over revolution state of the engine has been determined based on engine speed or throttle opening. Thus, the engine will not be held in an over revolution state, and therefore, significant damage to the engine can be avoided.

It is to be noted that, as used herein, the phrase in the format "at least one of X and Y" is intended to mean "X and/or Y".

Although these inventions have been disclosed in the context of certain preferred embodiments and examples, it will be understood by those skilled in the art that the present inventions extend beyond the specifically disclosed embodiments to other alternative embodiments and/or uses of the inventions and obvious modifications and equivalents thereof. In addition, while several variations of the inventions have been shown and described in detail, other modifications, which are within the scope of these inventions, will be readily apparent to those of skill in the art based upon this disclosure. It is also contemplated that various combination or sub-combinations of the specific features and aspects of the embodiments may be made and still fall within the scope of the inventions. It should be understood that various features and aspects of the disclosed embodiments can be combined with or substituted for one another in order to form varying modes of the disclosed inventions. Thus, it is intended that the scope of at least some of the present inventions herein disclosed should not be limited by the particular disclosed embodiments described above.

What is claimed is:

1. An operation control apparatus for a planing boat, comprising:

an engine;

a throttle valve configured to adjust an amount of airflow to the engine;

an accelerator configured to allow an operator to control an opening of the throttle valve;

a mode setting device configured to selectively set one of a normal driving mode and a speed setting mode, wherein the normal driving mode enables the boat to run at a speed in response to an operation amount of the accelerator and the speed setting mode enables the boat to run at a certain speed when a speed setting operating element has been operated; and an operating state determining device comprising a planing state determining device configured to determine whether or not the planing boat is in a planing state;

wherein the mode setting device is configured to disable and enable mode setting into the speed setting mode depending on whether or not the planing boat is in the planing state.

2. The operation control apparatus for a planing boat according to claim 1, wherein the operating state determining device comprises an engine speed detecting device configured to detect a speed of the engine, the operating state determining device being configured to determine that the engine is in a certain operating state if the detected engine speed is larger than a preset upper limit rotational speed, wherein the mode setting device is configured to disable mode setting into the speed setting mode if the certain operating state of the engine has been determined.

3. The operation control apparatus for a planing boat according to claim 1, wherein the operating state determining device comprises an accelerator operation amount detecting device configured to detect an operation amount of the accelerator, the operating state determining device being configured to determine that the engine is in a certain operating state if the detected accelerator operation amount is larger than a preset upper limit operation amount, wherein the mode setting device is configured to disable mode setting into the speed setting mode if the certain operating state of the engine has been determined.

4. The operation control apparatus for a planing boat according to claim 1, wherein the operating state determining device comprises a throttle opening detecting device configured to detect an opening amount of the throttle valve, the operating state determining device being configured to determine that the engine is in a certain operating state if the detected throttle opening is larger than a preset upper limit opening, wherein the mode setting device is configured to disable mode setting into the speed setting mode if the certain operating state of the engine has been determined.

5. The operation control apparatus for a planing boat according to claim 1, wherein the operating state determining device comprises an engine speed detecting device configured to detect the speed of the engine and an accelerator operation amount detecting device configured to detect the operation amount of the accelerator, wherein the operating state determining device is configured to determine that the engine is in a certain operating state if at least one of the detected engine speed is larger than a preset upper limit rotational speed and the detected accelerator operation amount is larger than a preset upper limit operation amount, wherein the mode setting device is configured to disable mode setting into the speed setting mode if the certain operating state of the engine has been determined.

6. The operation control apparatus for a planing boat according to claim 1, wherein the operating state determining device comprises an engine speed detecting device configured to for detect the speed of the engine, a throttle opening detecting device configured to detect the opening of the throttle valve, wherein the operating state determining device is configured to determine that the engine is in a certain operating state if at least one of the detected engine speed is larger than a preset upper limit rotational speed or if the detected throttle valve opening is larger than a preset upper limit opening, and wherein the mode setting device is configured to disable mode setting into the speed setting mode if the certain operating state of the engine has been determined.

7. An operation control apparatus for a planing boat, comprising:

an engine;

a throttle valve configured to adjust an amount of airflow to the engine;

an accelerator configured to allow an operator to control an opening of the throttle valve;

a mode setting device configured to selectively set one of a normal driving mode and a speed setting mode, wherein the normal driving mode enables the boat to run at a speed in response to an operation amount of the accelerator and the speed setting mode enables the boat to run at a certain speed when a speed setting operating element has been operated; and an operating state determining device configured to determine whether or not the engine is in a certain operating state;

wherein the mode setting device is configured to disable mode setting into the speed setting mode if the certain operating state of the engine has been determined, and to enable mode setting into the speed setting mode if the engine is not in the certain operating state;

wherein the operation control apparatus further comprises a planing state determining device configured to determine whether or not a hull of the planing boat is in a planing state, wherein the mode setting device is configured to prevent mode setting into the speed setting mode if at least one of the hull is not in a planing state and the engine is in the certain operating state, mode setting device also being configured to and allow mode setting into the speed setting mode if the hull is in the planing state and the engine is not in the certain operating state.

8. The operation control apparatus for a planing boat according to claim 7, wherein the planing state determining device is configured to determine that the hull is not in a planing state if a moving average obtained using engine speeds continues to be smaller than a preset value for a preset period of time or longer.

9. The operation control apparatus for a planing boat according to claim 7, wherein the planing state determining device is configured to determine that the hull is not in the planing state if at least one of the engine speed continues to be smaller than a lower limit rotational speed, which is smaller than an upper limit rotational speed at which the certain operating state is determined, for a preset period of time or longer, and if a boat speed continues to be smaller than a preset lower limit running speed for a preset period of time or longer.

10. An operation control apparatus for a planing boat, comprising:

an engine;

a power output request device configured to allow an operator of the planing boat to issue a request for power from the engine;

a speed control mode input device configured to allow an operator of the boat to issue a speed control mode switching command for switching between a normal mode and a speed control mode;

a controller configured to control a power output of the engine based on the request from the power output request device, the controller operating the engine at a speed in response to the request from the power output request device in the normal mode and operating the engine at a speed chosen by the operator with the speed control mode input device;

a mode setting device configured to selectively set one of the normal mode and the speed setting mode based in part on the switching command, wherein the normal driving mode enables the boat to run at a speed in response to an operation amount of the accelerator and the speed setting mode enables the boat to run at a certain speed when a speed setting operating element has been operated; and an operating state determining device configured to determine whether or not the planing boat is in a planing state;

wherein the mode setting device is configured to disable mode setting into the speed setting mode if the planing boat is not in the planing state, and to enable mode setting into the speed setting mode if the planing boat is in the planing state.

11. The operation control apparatus for a planing boat according to claim 10, wherein the mode setting device is configured to maintain the speed setting mode when the power output request device is adjusted within a range between a minimum power output request value and a maximum power output request value.

* * * * *